US010736362B2

(12) United States Patent
Giveans

(10) Patent No.: US 10,736,362 B2
(45) Date of Patent: Aug. 11, 2020

(54) INFANT SWADDLE DEVICE AND METHOD

(71) Applicant: Marc Russell Giveans, Colorado Springs, CO (US)

(72) Inventor: Marc Russell Giveans, Colorado Springs, CO (US)

( * ) Notice: Subject to any disclaimer, the term of this patent is extended or adjusted under 35 U.S.C. 154(b) by 0 days.

(21) Appl. No.: 16/174,244

(22) Filed: Oct. 29, 2018

(65) Prior Publication Data

US 2019/0125005 A1 May 2, 2019

Related U.S. Application Data

(60) Provisional application No. 62/579,128, filed on Oct. 30, 2017.

(51) Int. Cl.
*A41B 13/06* (2006.01)
*A41B 13/08* (2006.01)

(52) U.S. Cl.
CPC ..... *A41B 13/06* (2013.01); *A41B 13/08* (2013.01); *A41B 2300/32* (2013.01); *A41B 2400/44* (2013.01)

(58) Field of Classification Search
CPC ..... A41B 13/06; A41B 13/00; A41B 13/08; A41B 13/10; A41B 2400/44; A41B 2300/32; A47D 15/008; A47G 9/083; A47G 9/0223; A61F 5/3784
USPC ..... 128/872; 5/655, 494; 2/69.5
See application file for complete search history.

(56) References Cited

U.S. PATENT DOCUMENTS 1,169,607 A * 1/1916 Blenis ..... A41B 13/06 128/873
1,875,525 A * 9/1932 Thexton et al. ..... A47G 9/083 5/494
2,530,464 A * 11/1950 Haman ..... A41B 13/06 2/69.5
2,624,048 A * 1/1953 Kovary ..... A41B 13/06 2/69.5
2,651,781 A * 9/1953 Buchholz ..... A47D 15/008 2/69.5
2,722,694 A * 11/1955 Bryant ..... A61F 5/3776 128/872
3,315,671 A * 4/1967 Creelman ..... A61F 5/3715 128/870
5,129,406 A * 7/1992 Magnusen ..... A41B 13/06 128/845
7,254,849 B1 * 8/2007 Fiebrich ..... A41B 13/06 2/69.5
8,215,313 B1 * 7/2012 Waltz ..... A61F 5/3715 128/849
8,302,225 B1 * 11/2012 Earnest ..... A47G 9/083 5/413 R (Continued)

*Primary Examiner* — Nathan E Durham
*Assistant Examiner* — Abby M Spatz
(74) *Attorney, Agent, or Firm* — Skaar Ulbrich Macari, P.A.

(57) ABSTRACT

A swaddle device includes a body portion and a pair of laterally extending wings. The first wing includes a first opening defined therein so that the infant's first arm can be inserted through the opening when swaddling the infant. A second opening is defined in the first wing adjacent to the first opening. A third opening can also be provided through the second wing to allow for the option of the infant to be swaddled with their first arm intentionally protruding, yet captured.

6 Claims, 8 Drawing Sheets

(56) References Cited

U.S. PATENT DOCUMENTS 8,745,794 B1 * 6/2014 McDermott ..... A41B 13/06 2/69.5
8,863,329 B2 * 10/2014 Gangan ..... A41B 13/06 2/69.5
2004/0019969 A1 * 2/2004 Gatten ..... A41B 13/06 5/482
2008/0120774 A1 * 5/2008 Hite ..... A41B 13/06 5/494
2009/0064390 A1 * 3/2009 Beiring ..... A41B 13/06 2/80
2010/0212060 A1 * 8/2010 Whitcomb ..... A41B 13/06 2/75
2010/0299801 A1 * 12/2010 Nilsson ..... A41B 13/06 2/69.5
2011/0035857 A1 * 2/2011 Quintanilla ..... A41B 13/06 2/52
2011/0179546 A1 * 7/2011 Millette ..... A41B 13/06 2/75
2011/0277210 A1 * 11/2011 Hardesty ..... A41B 13/06 2/69.5
2012/0110716 A1 * 5/2012 Christensen ..... A41B 13/06 2/69.5
2012/0311762 A1 * 12/2012 Aiken ..... A41B 13/06 2/69.5
2013/0333113 A1 * 12/2013 Gotel ..... A41B 13/06 5/494
2014/0020176 A1 * 1/2014 Coates ..... A41B 13/06 5/494
2014/0020177 A1 * 1/2014 Coates ..... A41B 13/06 5/494
2014/0150159 A1 * 6/2014 Alluna ..... A47D 13/02 2/69.5
2015/0342263 A1 * 12/2015 Taylor ..... A41B 13/06 2/69.5
2016/0037827 A1 * 2/2016 Rogers ..... A41B 13/06 5/655
2016/0081863 A1 * 3/2016 Belsinger, Jr. ..... A61G 1/003 128/872
2016/0157642 A1 * 6/2016 Xiong ..... A47G 9/083 2/80
2016/0174619 A1 * 6/2016 Waters ..... A41B 13/065 2/69.5

* cited by examiner

INFANT SWADDLE DEVICE AND METHOD

PRIORITY

This application claims the priority benefit of U.S. Provisional Application Ser. No. 62/579,128, filed on Oct. 30, 2017, which is hereby incorporated herein by reference in its entirety.

FIELD

The present invention relates generally to swaddling devices and methods for infants, and more particularly to swaddling devices and methods to control an infant's hands.

BACKGROUND

Babies have historically been swaddled in a blanket to keep them comfortable, yet snug while they sleep. The theory behind this is that infants (babies in their first 6 months) are most comfortable being tightly enclosed, including keeping their arms against their body, which may simulate the intimacy of the womb. By using simple techniques, a standard blanket can be folded and wrapped around the infant to keep them tightly wrapped in a warm environment, including keeping their arms tightly against their body while they sleep.

In the past decade or two, several companies have created specially-designed swaddle devices, which are essentially blankets that are designed to be worn by the infant. The devices are either wrapped or zipped, and incorporate "wings" that can be simply wrapped across the infant's body. The wings keep the infant snug and keep their arms closely by their sides. These wings are usually secured either by VELCRO (hook and loop fastener) straps or by tucking the ends of the wings into the main cylinder formed around the swaddled infant.

As the infant reaches the approximate 2-6 month age window, their arms attain enough strength to "break free" of the swaddle position. This results usually in a free hand escaping out of the top portion of the swaddle cylinder (in front of the neck just under the chin). This free hand often wakes the infant up from their sleep, and/or prohibits them from falling back to sleep due to the hand being used as a stimulant. Because infants at this age do not yet have full control of their extremities, this free hand can be very disturbing for the infant, and causes them to either stay awake and/or cry, thus disrupting their cycle of sleep.

The conventional solution to the free hand escape problem, other than encouraging parents to more tightly wrap their infants so as to prevent their hands from breaking free, is to include "pockets" inside of the swaddle device. The infant's hands/arms are placed into these pockets during the swaddling process to better secure the hand placement.

While the pockets solution does help address the free hand issue, some renditions of the pockets still allow the infant to flex their biceps and allow their hand to migrate up towards their chin, while still inside of the swaddle. This still allows the infant to touch their neck and chin even though their hand is still inside of the swaddle. The renditions that use smaller pockets may restrict how tightly the wrap is able to be secured, as it may force the infant's hand to be placed too far medially across the stomach or chest. Finally, adding pockets within these swaddle "wings" increases the cost of production for the swaddle device.

Therefore, there is a continuing need to overcome the disadvantages of the conventional swaddling devices and methods as completely as possible.

SUMMARY

The present invention provides an improved swaddling device and method that solves the issue of the "break free hand" in a manner that is biomechanically effective because the infant's hand cannot migrate up towards their neck and chin area. The swaddle device includes a body portion and a pair of laterally extending wings. The right wing includes a first opening defined therein so that the infant's right arm can be inserted through the opening when swaddling the infant. A second opening is defined in the right wing adjacent to the first opening. A third opening can also be provided through the left wing to allow for the option of the infant to be swaddled with their right arm intentionally protruding, yet captured.

Provided herein is an infant swaddle device that includes a body portion, a first wing and a second wing. The first wing is attached to the body portion and extends laterally away from the body portion. The second wing is attached to the body portion on an opposite side of the body portion as compared to the first wing, and extends laterally away from the body portion in a direction opposite the first wing. The first wing includes a first opening defined through a thickness of the first wing. The first opening is laterally offset from the body portion. The first wing also includes a second opening defined through the thickness of the first wing. The second opening is more laterally offset from the body portion than the first opening.

The second wing can include a third opening defined through a thickness of the second wing that is laterally offset from the body portion. The third opening can be more laterally offset from the body portion than the first opening, but less offset from the body portion than the second opening.

The body portion is configured as a flat piece of material, a sleep sack, a onesie or other infant article.

A portion of a hook and loop fastener is secured to the second wing to secure the second wing to the body portion when the swaddle is completed.

Also provided is a method of swaddling an infant with a swaddling device. The method can include placing the infant on top of, or inside of, a body portion of the swaddle device. The first arm of the infant is inserted in a first direction through a first opening in a first wing of the swaddle device so that the first arm protrudes outward through the first opening when the first wing is folded across the infant towards a second arm of the infant. The first wing is folded across the infant towards the second arm of the infant. The second arm of the infant is inserted through a second opening in the first wing from a second direction opposite that of the first direction so that the second arm is located inside of the first wing. A second wing of the swaddle device is pulled across the infant so that the second wing extends over the first wing, the infant's first arm and the infant's second arm.

The second wing to the body portion of the swaddle device can be secured in place with a portion of hook and loop fastener provided to the second wing.

A glove can be placed on the first hand of the infant prior to pulling the second wing of the swaddle device across the infant.

The first arm of the infant can be inserted though a third opening in the second wing of the swaddle device so that the first arm protrudes outward through the third opening when the second wing of the swaddle device is pulled across the infant.

The infant can be zipped into the body portion.

The steps of inserting the first arm of the infant in the first direction through the first opening in the first wing and folding the first wing across the infant towards the second arm of the infant can be performed simultaneously.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
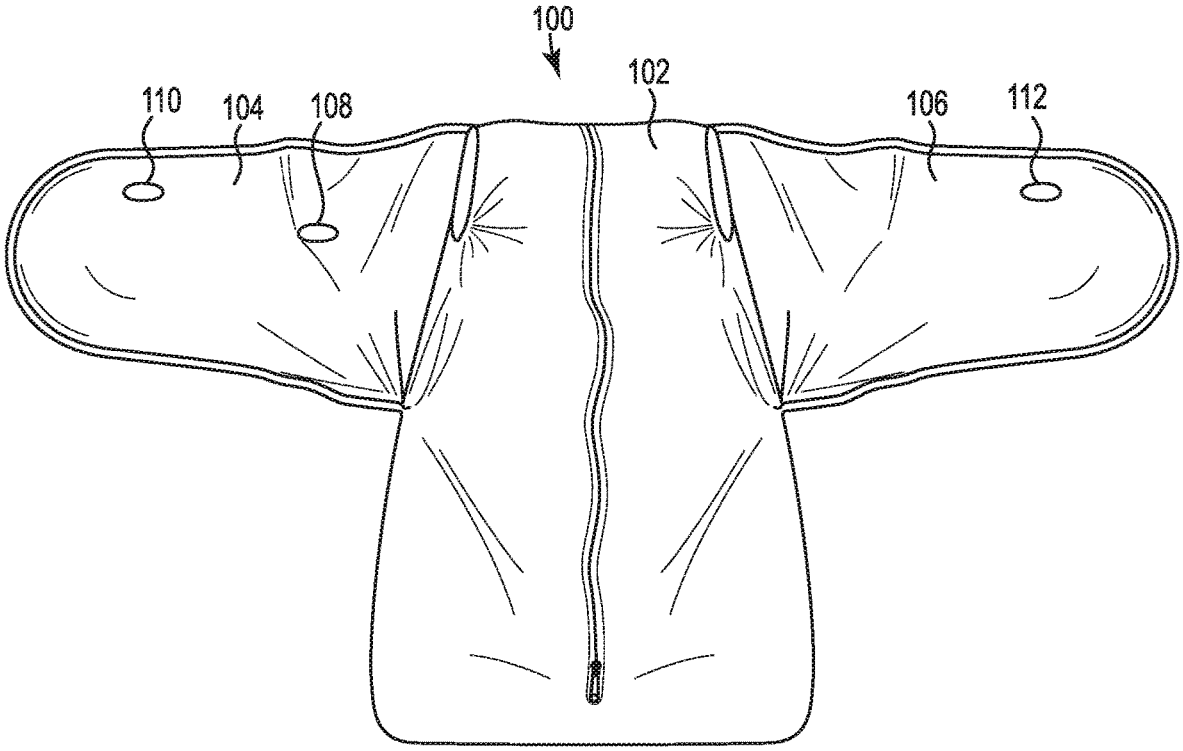
FIG. 1 is a plan view of a device for swaddling an infant according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring to FIG. 1, a swaddle device 100 includes a body portion 102 and laterally extending wings 104 and 106. The right wing 104 (on the left side as one views the figure) includes a first opening 108 defined therein adjacent to the body portion so that the infant's right arm can be inserted through the first opening 108 when swaddling the infant. A second opening 110 is also defined in the right wing 104 adjacent to the first opening 108 but farther away from the body 102 than the first opening 108.

A third opening 112 can also be defined through the left wing 106 to allow for the option of the infant to be swaddled with their right arm intentionally protruding through the completed swaddle, yet captured or secured by the swaddle.

It should be understood that the references to right and left are relative and can be reversed without departing from the scope of the invention. Also, the swaddle device 100 can be formed in a mirror image of that shown in FIG. 1. Moreover, the body portion 102 can be configured in numerous ways, such as the depicted body sack, as a onesie, or as a simple flat material, or in other configurations without departing from the scope of the invention.

Figure 5:
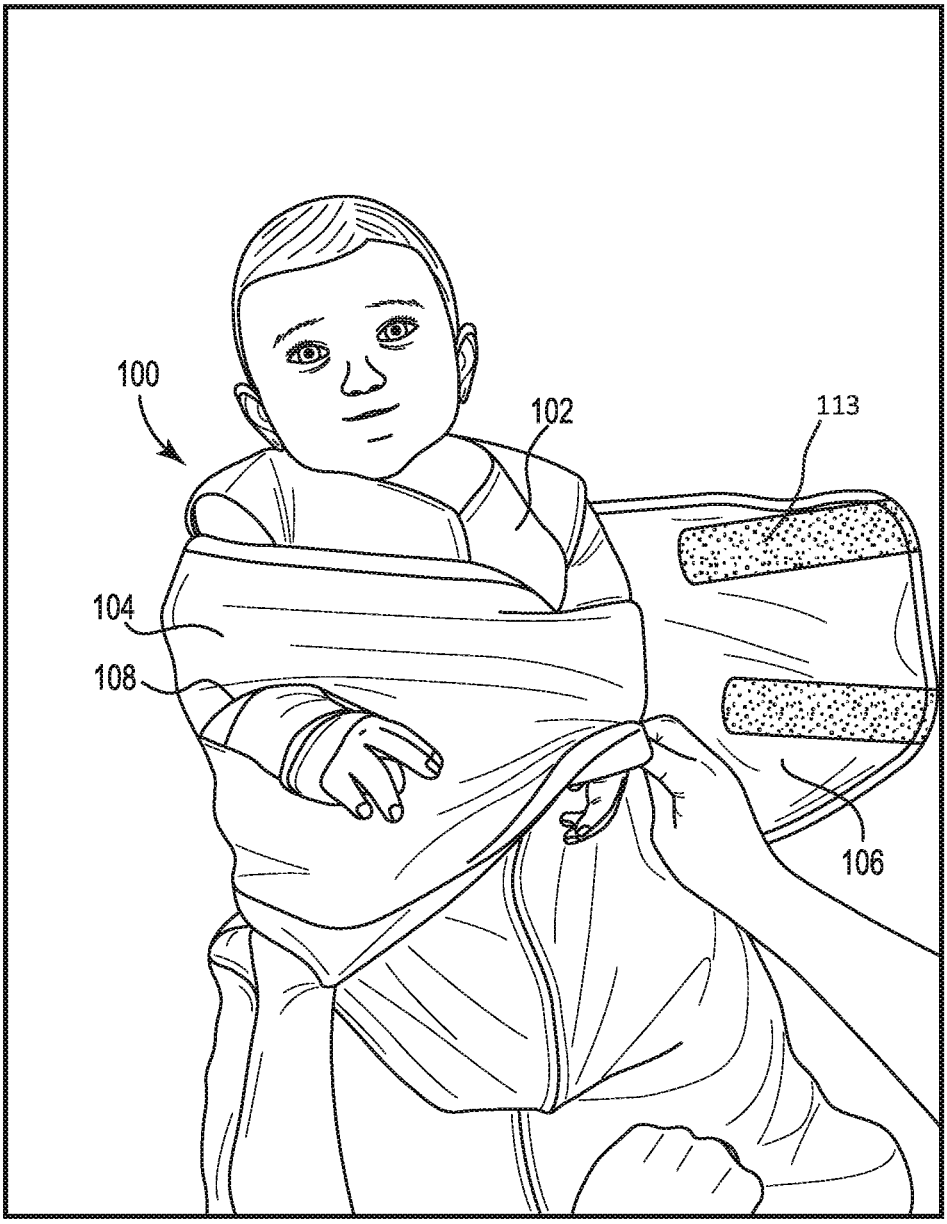

A portion of hook and loop fastener 113 is provided to the left wing 106 as shown in FIG. 5 so that the wing can be secured to the body portion where the side or back of the infant is located when the swaddle is completed. A corresponding portion of the hook and loop fastener can be provided to the back side of the body portion for mating with the portion 113 on the left wing 106.

The swaddle device 100 resolves the issue of the "break free hand" in a manner that is biomechanically effective because the infant's hand cannot migrate up towards their neck and chin area. The swaddle device also adds little, if any, manufacturing cost as compared to the conventional swaddle devices.

Figure 2:
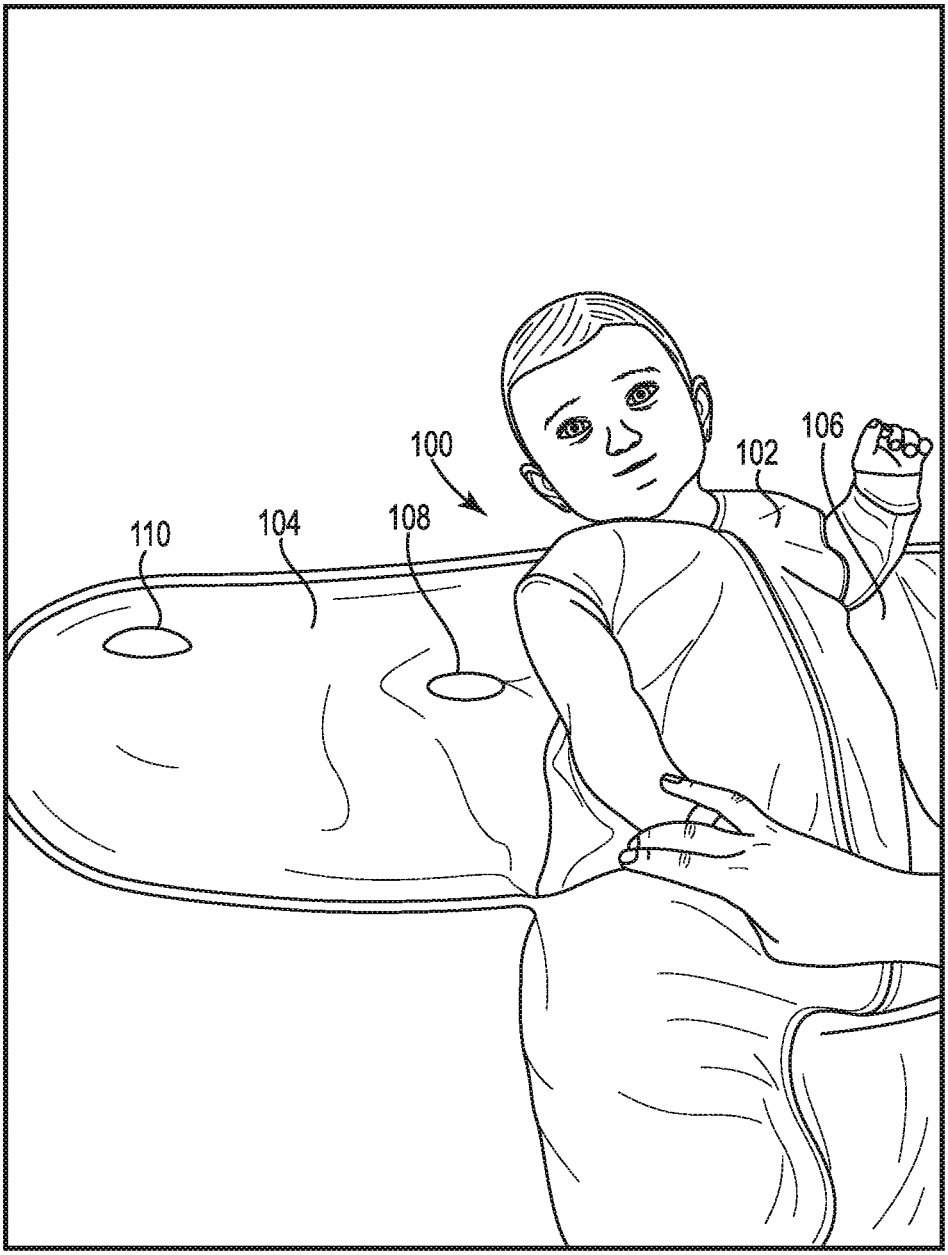
FIGS. 2-6 are images showing ordered steps for a method of swaddling an infant according to certain embodiments.
Figure 6:
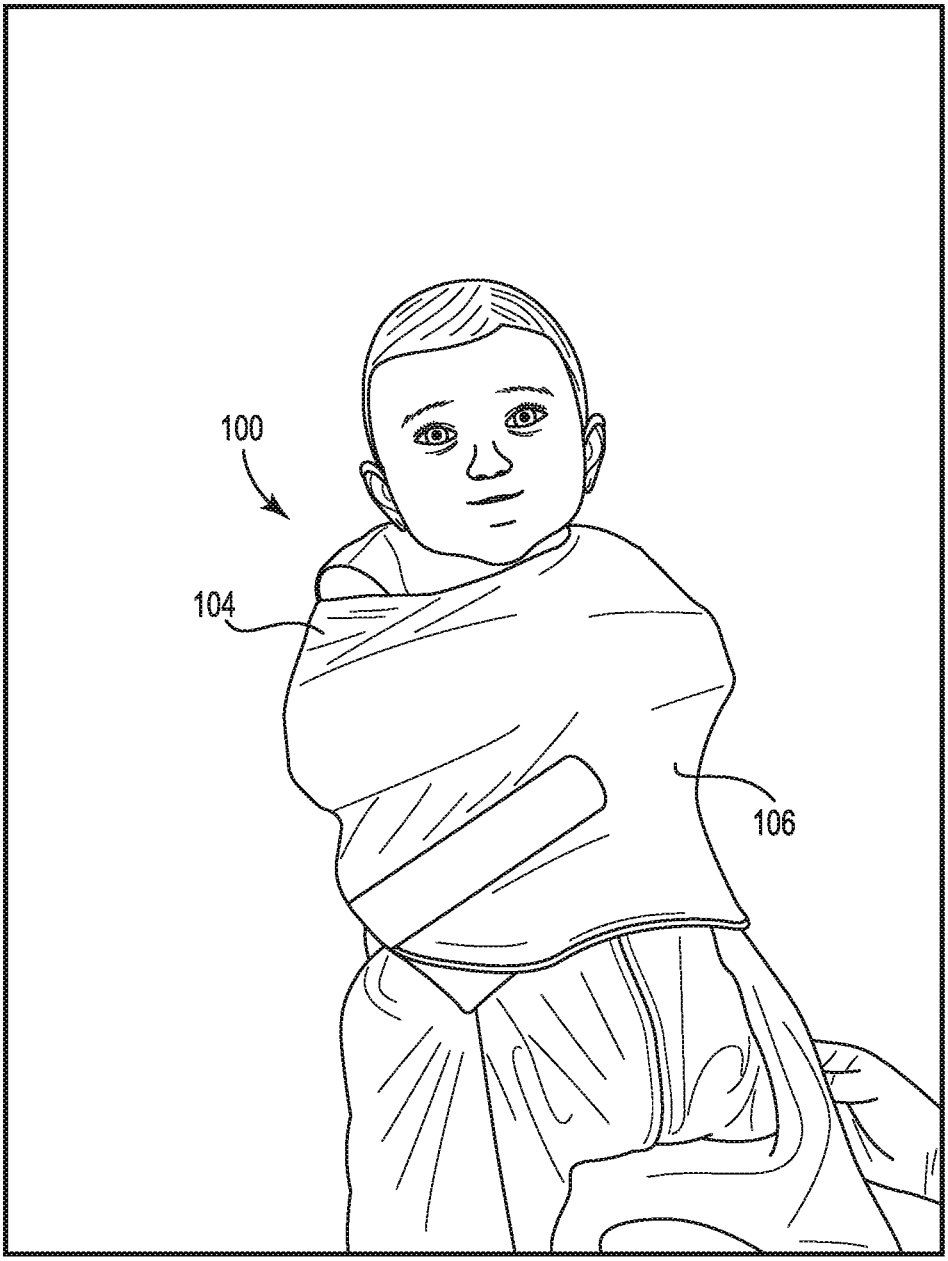
Figure 7:
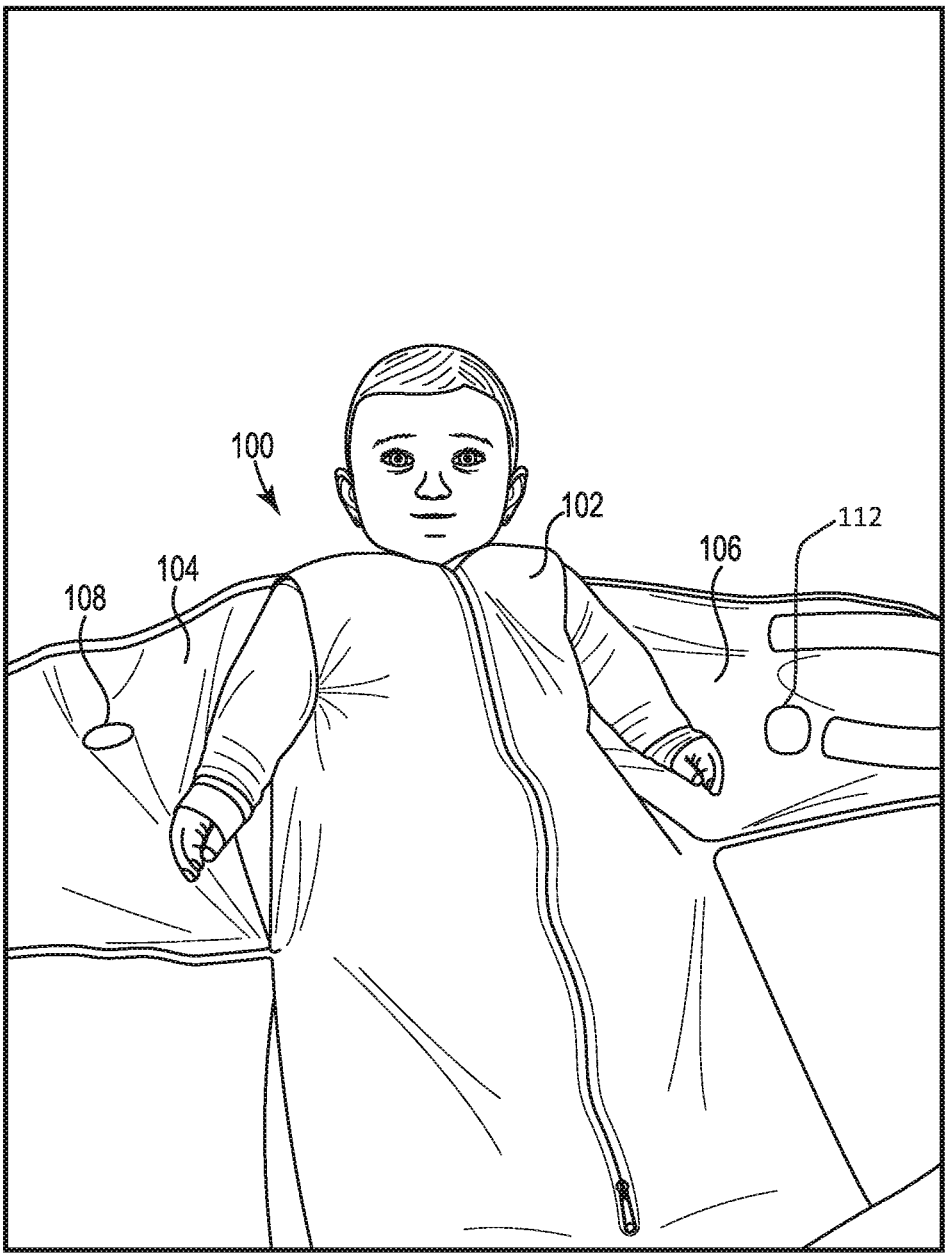
FIG. 7 is an image of an alternate configuration of the body portion of the swaddling device according to certain embodiments.

Referring to FIGS. 2-8, in use, the infant is placed on top of (or inside of) the swaddle body portion 102 with both wings 104, 106 extended laterally outward as shown in FIGS. 2 and 7. FIG. 2 and FIG. 7 each show a different configuration of the body 102. In FIG. 2, the body is a flat piece of material. In FIG. 7, the body 102 is configured as a zippered sleep sack.

Figure 3:
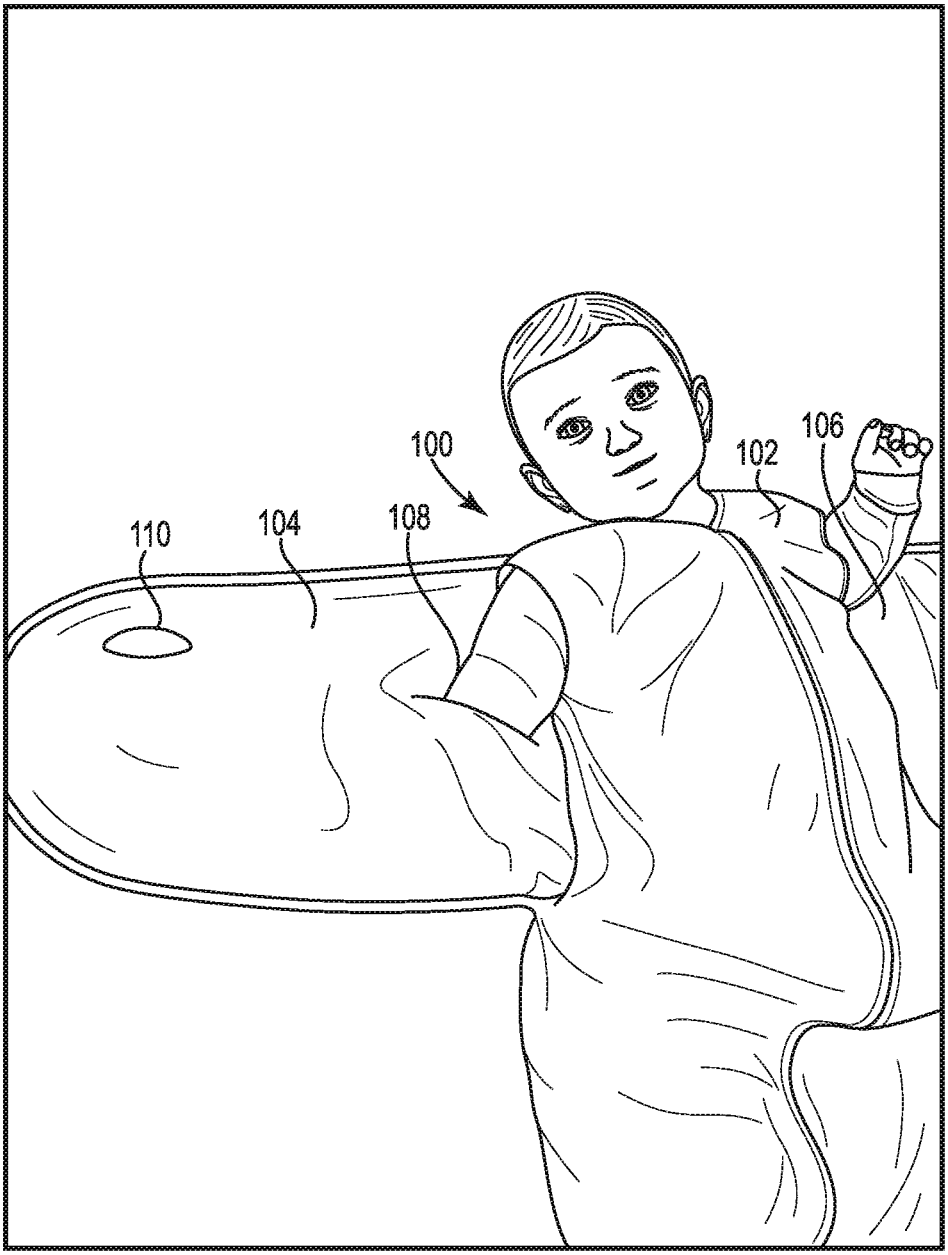
Figure 4:
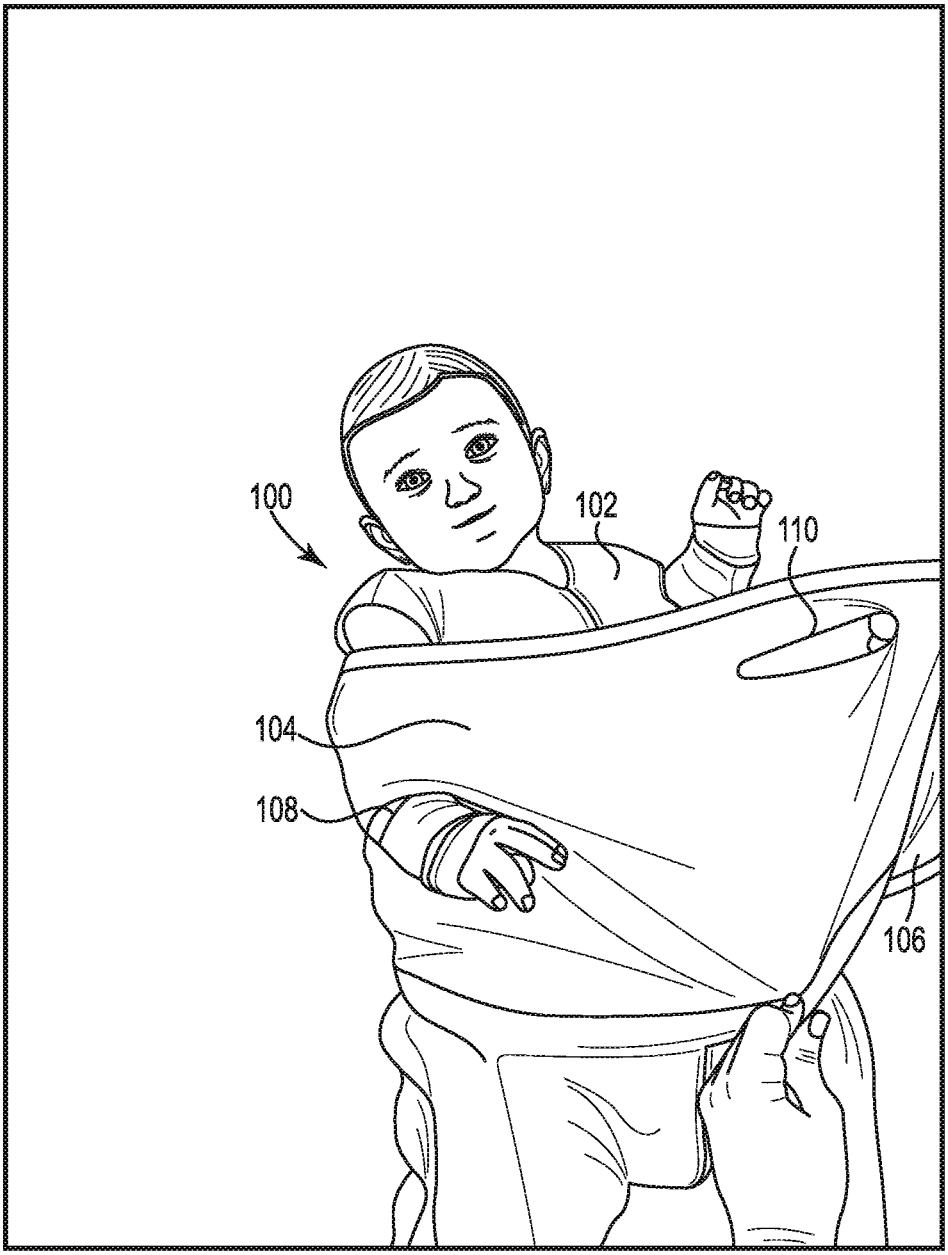

Next, the infant's right arm is inserted through the first opening 108 in the right wing 104 as shown in FIG. 3. The right wing 104 is then folded across the infant's body as shown in FIG. 4. These steps can be performed simultaneously.

The first opening 108 is located directly in the middle of the right wing 104, shifted slightly towards the midline of the entire swaddle 100. The infant's right arm is inserted through this opening 108 from under the swaddle wing 104 such that the arm extends outside of the wing 104 as can be seen in FIGS. 3-4. The first opening 108 is located relative to the body 102 in such a manner that the infant's elbow does not protrude all the way through the opening 108, but rather just the majority of the lower arm/forearm protrudes as shown in FIG. 4.

Next, the right wing 104 is pulled tightly across the infant's body and tucked around the infant's left rib cage. The second opening 110 is located on the right wing 104 near the outer ⅓ portion of the right wing 104. The infant's left arm is inserted through this second opening 110, yet this time from outside of the wing 104 so that it extends inside of the wing 104 as shown in FIG. 5. Thus, when viewed from above, the infant's left hand is not visible as it in under, or inside of, the right wing 104.

The second opening 110 is optimally placed relative to the body portion 102 so that, again, the infant's elbow does not extend through the opening 110. Instead, the majority of the lower arm/forearm will be placed through the opening 110. The reason for this is that this positioning adds additional resistance against the biceps, making it more difficult for the infant to flex his or her elbow and bring the hand up towards the neck.

Figure 8:
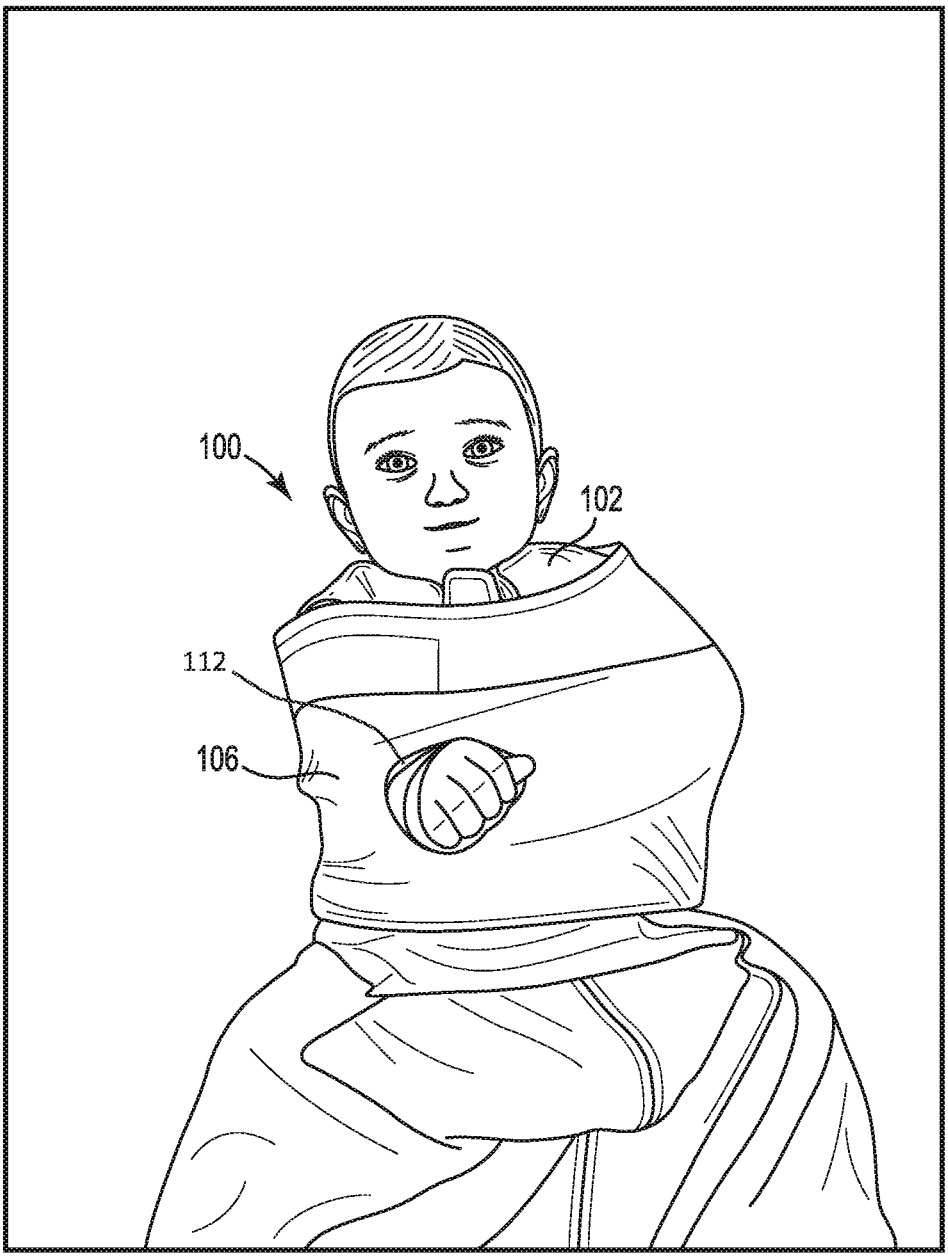
FIG. 8 is an image of an additional step of a method of swaddling an infant according to certain embodiments.

Finally, the left wing 106 is pulled tightly across the infant's entire body as shown in FIG. 6. The left wing 106 is fixed near the infant's right rib cage, or even around the right side of the infant's back, depending on how big the infant is and how flexible the wing material is. This left wing 106 adds a second layer on top of both arms, which are both being biomechanically prevented from flexing by extending through the wing openings 108, 110. Based on where the hook and loop straps are located on the left wing 106, there may be an issue with rubbing against the exposed right hand (which recall is extended outside of the right wing 104, thus exposing the hand to the underside of the left wing). This can be addressed in one of several ways:

1) By placing a glove on the infant's right hand (preventing any irritation from rubbing against the hook and loop material portion on the underside of the left wing 106;

2) By changing the orientation of the hook and loop straps on the underside of the left wing 106 (so as not to make contact with the exposed right hand); or 3) By adding a third opening 112 defined through the left wing 106, where the exposed right hand could be placed through the third opening 112 as shown in FIG. 7. This opening causes the right hand to protrude through the entire swaddle device and be exposed to the outside world (while the rest of the body, including the majority of the infant's right arm) is wrapped tightly beneath the swaddle as can be seen in FIG. 8.

The swaddle device and methods disclosed herein address the break free hand issue at little or no additional manufacturing cost. Moreover, parents receive the peace of mind that they can still swaddle their infant as tightly as they would like, but with the added option that the device biomechanically prevents their infant from breaking free with one hand (or two) and thus waking them up from their valuable sleep time.

Other features and aspects of the invention can be appreciated from the depictions in the figures, even if not described in writing herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A method of swaddling an infant with a swaddle device, the method comprising:

placing the infant on top of, or inside of, a body portion of the swaddle device;

inserting a first arm of the infant in a first direction through a first opening in a first wing of the swaddle device so that the first arm protrudes outward through the first opening when the first wing is folded across the infant towards a second arm of the infant;

folding the first wing across the infant towards the second arm of the infant;

inserting the second arm of the infant through a second opening in the first wing from a second direction opposite that of the first direction so that the second arm is located inside of the first wing; and pulling a second wing of the swaddle device across the infant so that the second wing extends over the first wing, the infant's first arm and the infant's second arm.

2. The method of claim 1, further comprising securing the second wing to the body portion of the swaddle device with a portion of hook and loop fastener.

3. The method of claim 1, further comprising placing a glove on a first hand of the infant prior to pulling the second wing of the swaddle device across the infant.

4. The method of claim 1, further comprising inserting the first arm of the infant through a third opening in the second wing of the swaddle device so that the first arm protrudes outward through the third opening when the second wing of the swaddle device is pulled across the infant.

5. The method of claim 1, further comprising zipping the infant into the body portion.

6. The method of claim 1, wherein the steps of inserting the first arm of the infant in the first direction through the first opening in the first wing and folding the first wing across the infant towards the second arm of the infant are performed simultaneously.

* * * * *